US007090438B2

(12) United States Patent
Price et al.

(10) Patent No.: US 7,090,438 B2
(45) Date of Patent: Aug. 15, 2006

(54) BLOCK WITH MULTIFACETED BOTTOM SURFACE

(75) Inventors: Gerald P. Price, Rochester, MN (US); Raymond R. Price, Rochester, MN (US)

(73) Assignee: Rockwood Retaining Walls, Inc., Rochester, MN (US)

( * ) Notice: Subject to any disclaimer, the term of this patent is extended or adjusted under 35 U.S.C. 154(b) by 0 days.

(21) Appl. No.: 10/762,645

(22) Filed: Jan. 20, 2004

(65) Prior Publication Data

US 2004/0151550 A1 Aug. 5, 2004

Related U.S. Application Data

(60) Division of application No. 10/033,460, filed on Dec. 28, 2001, now abandoned, which is a continuation-in-part of application No. 09/811,119, filed on Mar. 17, 2001, now Pat. No. 6,682,269, which is a continuation-in-part of application No. 09/377,094, filed on Aug. 19, 1999, now Pat. No. 6,250,850.

(51) Int. Cl.
*E04B 5/04* (2006.01)
*E04C 2/04* (2006.01)

(52) U.S. Cl. ..... 405/284; 52/603; 52/605; 52/606; 52/607; 52/608

(58) Field of Classification Search ..... 52/596, 52/604, 608, 609; 405/284; D25/113
See application file for complete search history.

(56) References Cited

U.S. PATENT DOCUMENTS 379,429 A 3/1888 Werth
572,762 A 12/1896 Landers
D31,267 S 7/1899 Bates
D34,284 S 3/1901 Forsberg
787,199 A 4/1905 Lloyd
1,727,363 A 9/1929 Glenn
1,816,916 A 8/1931 Sentrop
1,905,975 A 4/1933 Thomas
2,313,363 A 3/1943 Schmitt
2,566,787 A 9/1951 Zevely
2,586,210 A 2/1952 Corwin (Continued)

FOREIGN PATENT DOCUMENTS

CH 663 437 5 12/1987

OTHER PUBLICATIONS

Keystone brochure entitled "Beautiful Do-It-Yourself Results", Library of Congress, Jun. 27, 1988, 1 page.

(Continued)

*Primary Examiner*—Gary S. Hartmann
(74) *Attorney, Agent, or Firm*—Patterson, Thuente, Skaar & Christensen, P.A.

(57) ABSTRACT

A block for use in constructing a multiple course retaining wall. The block has a substantially planar top surface, a front surface, wherein said front surface is of a substantially curvilinear shape, a rear surface, opposed side surfaces, and a bottom surface. The bottom surface has a predetermined area and a non-planar portion, with the non-planar portion comprising a continuous area making up at least one-quarter of the bottom surface and creating a cavity between the bottom surface of the block and a top surface of a lower course of blocks when the block is placed on the top surface of the lower course of blocks. The cavity allows dirt and other foreign matter to exist between successive courses of blocks without creating instability between the block and the lower course of blocks.

9 Claims, 8 Drawing Sheets

U.S. PATENT DOCUMENTS

| | | | | | |
|---|---|---|---|---|---|
| D201,966 | S | | 8/1965 | Forsberg | |
| 3,545,053 | A | | 12/1970 | Besser | |
| 3,679,340 | A | | 7/1972 | Springs | |
| 4,019,848 | A | | 4/1977 | Balhorn | |
| 4,139,593 | A | | 2/1979 | Holz et al. | |
| 4,335,549 | A | | 6/1982 | Dean, Jr. | |
| D270,189 | S | | 8/1983 | Khoo | |
| 4,411,119 | A | | 10/1983 | Miller | |
| 4,445,802 | A | | 5/1984 | Loov | |
| D280,024 | S | | 8/1985 | Risi et al. | |
| 4,616,959 | A | | 10/1986 | Hilfiker | |
| D295,788 | S | | 5/1988 | Forsberg | |
| D296,007 | S | | 5/1988 | Forsberg | |
| D297,464 | S | | 8/1988 | Forsberg | |
| D299,067 | S | | 12/1988 | Forsberg | |
| D301,063 | S | | 5/1989 | Risi et al. | |
| 4,825,619 | A | | 5/1989 | Forsberg | |
| 4,936,712 | A | | 6/1990 | Glickman | |
| D310,267 | S | | 8/1990 | Zeidman | |
| D311,444 | S | | 10/1990 | Forsberg | |
| D313,280 | S | | 12/1990 | Rodenburgh et al. | |
| 5,044,834 | A | * | 9/1991 | Janopaul, Jr. | 405/284 |
| 5,062,610 | A | * | 11/1991 | Woolford et al. | 249/52 |
| 5,072,566 | A | | 12/1991 | Zeidman | |
| 5,281,048 | A | | 1/1994 | Hagenah | |
| 5,294,216 | A | * | 3/1994 | Sievert | 405/286 |
| 5,622,456 | A | | 4/1997 | Risi et al. | |
| D380,560 | S | | 7/1997 | Forsberg | |
| 5,711,130 | A | | 1/1998 | Shatley | |
| 5,827,015 | A | * | 10/1998 | Woolford et al. | 405/286 |
| 5,943,827 | A | * | 8/1999 | Okerlund | 52/28 |
| 5,984,589 | A | | 11/1999 | Ciccarello | |
| 6,019,550 | A | | 2/2000 | Wrigley et al. | |
| 6,099,942 | A | | 8/2000 | Yakushinji | |
| 6,178,715 | B1 | | 1/2001 | Pacitto et al. | |
| 6,250,850 | B1 | * | 6/2001 | Price et al. | 405/284 |
| 6,312,197 | B1 | | 11/2001 | Woolford et al. | |
| D458,693 | S | | 6/2002 | Sievert | |
| 6,592,301 | B1 | | 7/2003 | Price et al. | |
| 6,682,269 | B1 | * | 1/2004 | Price et al. | 405/284 |
| 6,850,850 | B1 | | 2/2005 | Renau | |
| 6,910,833 | B1 | | 6/2005 | Price et al. | |

OTHER PUBLICATIONS

Johnson Block Product, Retaining Wall System, 2 pages.
Handy-Stone Retaining Wall System, Copyright 1989, 3 pages.
Rockwood E-Z Wall Block Brochure, 1989, 4 pages.
Johnson Block price lists, 4 pages.
Declaration of Al. Pfannenstein, Aug. 28, 1998, 6 pages.
Anchor Block Company/Oscar Roberts Concrete Products, Diamond Wall System Tech Spec. Sep. 1988, 2 pages.
Anchor Block Company, Terastone Wall System Tech Spec., Sep. 1988, 2 pages.
"Garden Wall", Keystone Retaining Wall Systems product literature, 1991, 3 pages.
"Keystone Intermediate", Keystone Retaining Wall Systems product literature, 1994, 2 pages.

* cited by examiner

BLOCK WITH MULTIFACETED BOTTOM SURFACE

CROSS REFERENCE

This application is a division of U.S. patent application Ser. No. 10/033,460filed on Dec. 28, 200 now abandoned, which is a continuation-in-part of U.S. patent application Ser. No. 09/811,119 filed Mar. 17, 2001 now U.S. Pat. No. 6,682,269which is a continuation-in-part of U.S. patent application Ser. No. 09/377,094 filed on Aug. 19, 1999, now U.S. Pat. No. 6,250,850.

FIELD OF THE INVENTION

This invention relates generally to retaining walls. More particularly, the present invention relates to manufactured blocks that are used to construct mortarless retaining walls.

BACKGROUND OF THE INVENTION

Retaining walls can be both functional and decorative and range from small gardening applications to large-scale construction. Such walls are typically used to maximize horizontal surface areas by providing lateral support between differing ground levels, and reduce the possibility of erosion and slumping. They may be constructed of a variety of materials and shapes. Some have been constructed of wood timbers, others of rock in a natural form (such as limestone). Still others have been constructed of manufactured aggregate or concrete blocks.

Constructing a fit and true retaining wall can be a more labor intensive and exacting endeavor than one would believe. In addition to laying a level first course, the builder must take pains to ensure that each subsequent course is level. Otherwise, an error made in positioning a block in a lower course may become magnified as successive courses are stacked thereabove and become readily apparent to the human eye. This is especially true of mortarless wall constructions because there is no way to effectively compensate for irregularities and discontinuities, as opposed to block and mortar construction.

Present mortarless wall building methods usually include laying a course of blocks, filling the space behind the course with fill material, packing the fill material, and carefully removing extraneous fill material from the top of each completed course prior to the addition of the next course. This fill material usually consists of small, stones or similar material and is preferred because it provides a path for moisture to follow and relieves water pressure that may build up behind a wall. It is also preferred because of its ability to reduce water borne material from seeping between the joints of the blocks due to inclement weather. The final step of removing the extraneous fill material is time consuming but necessary to ensure the next course of blocks lies flat in intimate contact on the lower course.

One particular problem the prior art has failed to overcome is developing a retaining wall block configured to minimize or prevent unintended discontinuities and irregularities caused by blocks being stacked on extraneous fill material, dirt, and debris that is often present on the upper surface of the lower course of blocks.

For example, some larger blocks incorporate through-holes that extend from their bottom surface to their top surfaces. These through-holes are intended to reduce the amount of material required to form the block, thereby reducing its cost and weight, and they also create space into which fill material may be introduced once a course is finished. At first blush it would appear that, because the presence of through-holes reduces the surface area of the top and bottom of the block, they would also serve to decrease the area of possible interference by small stones and debris between courses. However, the mere presence of through-holes ensures the chances that some of the fill material dumped therein will spill over onto the remaining upper surfaces. Thus, through-holes actually exacerbate, rather than alleviate the problem.

Smaller blocks, on the other hand, cannot easily incorporate through-holes without jeopardizing their structural integrity, and this inability of smaller blocks to accommodate through-holes creates other problems. Fabricating a solid block out of material such as concrete may often result in a block which may weigh as much as or more than a larger block that includes through-holes. And, working with such blocks may be more difficult than working with larger blocks with through-holes. That is, the absence of through-holes or interruptions in the side walls makes it difficult to grasp and lift these blocks. This becomes an important consideration in light of the number of blocks that must be lifted and set in place during the construction of even a relatively small retaining wall.

There is a need for a retaining wall block, which may accommodate debris between courses without adversely affecting the overall structure and aesthetics of the resulting wall. There is also a need for a small retaining wall block that has a reduced unit weight due to the absence of block material in an area that will not adversely affect the strength of the block or its appearance. And, there is a need for a small retaining wall block that is relatively easy to grasp and pick up off of a stack of similar blocks.

SUMMARY OF THE INVENTION

The present invention relates to a retaining wall block so shaped that when placed on top of a lower course of similar blocks, it lies flat despite the inevitable presence of dirt, small stones, and other debris. This feature alleviates the time-consuming step of meticulously cleaning the top of each course of blocks before the next course may be laid on top of it.

In order to achieve the tolerance of small stones and debris between courses, a portion of the bottom surface of the block of the present invention is non-planar, and preferably, concave. This non-planar portion significantly reduces the area for block-to-block contact between successive courses. It also functions to provide an area of clearance or a gap between adjacent blocks where debris can migrate without causing interference or instability between courses. The non-planar portion may be curved, preferably in the shape of a portion of a cylinder and extends from one side surface to the other. Alternatively, the non-planar portion could be shaped to form a portion of a sphere, oval, or any other shape that is capable of tolerating small stones and debris between courses. Preferably, the non-planar portion covers more than one half of the area of the bottom surface of the block.

In addition to the non-planar portion of the bottom surface, the present invention further comprises a plurality of grooves formed in the bottom surface and extending substantially transversely thereacross, preferably in parallel between the front and back surfaces. The grooves preferably are angled upwardly to form an inverted "V" shape when the block is given its intended orientation. The grooves allow spaces of increased clearance for larger stones. The grooves preferably comprise two opposed surfaces of a predetermined width and which are angled to form a "V" shape and meet to form an angle α. The angled walls of the grooves not only reduce the weight of the block and act as a splitting aid, but also act to direct larger stones into the grooves, thereby positioning them into an area of maximum clearance. Alternatively, the first and second surfaces may be joined by a third, curved or flat, surface juxtaposed between the first and second surfaces. Such a third surface would give the groove an inverted "U" shape. Preferably the grooves are integrally formed with the block and have a predetermined depth, which more or less follows the contour of the non-planar bottom surface.

The bottom surface further comprises one or more downward projections proximate the rear surface and having an abutting surface which contacts the rear surface of a lower course of blocks when the block is stacked thereon. It is envisioned that the abutting surface is either parallel to the rear surface of the block, or forms an angle β with the rear surface. These projections create an automatic and uniform setback among successive courses of blocks so that the resulting retaining wall is angled rearwardly. This also adds resistive strength to the wall against the natural forces exerted on the wall by the earth the wall is retaining, by tying successive courses of blocks to those course below them.

In an alternative embodiment, the block generally comprises a substantially continuous top surface, front and back surfaces extending from the top surface, multi-faceted side surfaces extending from the top surface and spanning from the front surface to perpendicularly intersect the back surface, and a bottom surface having a predetermined surface area that is integral with the front and side surfaces. An upwardly extending gutter is formed into the bottom surface of the block and is spaced away from the rear surface of the block a predetermined distance. The gutter formed into the bottom surface of the block preferably has a forward edge that has a minimal surface area that acts to support a rear portion of the block upon a lower course of blocks.

In order to further lighten a block constructed according this embodiment, the multifaceted side surfaces of the blocks include an inwardly inset sidewall portion that perpendicularly intersects the rear surface of the block. The multifaceted side surfaces of the block may further comprise a shoulder formed between the aforementioned sidewalls and a forward portion of the multifaceted side surfaces wherein the shoulder and the forward portion of the multifaceted side wall intersect at an obtuse angle.

Preferably, the downward projection has a generally trapezoidal cross-sectional shape and is spaced away from the rear surface of the block a predetermined distance. In addition, the abutting surface of the downward projection is preferably contiguous with a rear face of the gutter.

The front surface of the aforementioned preferred embodiments may be configured to have a plurality of planar segments or may be curvilinear. However, it is understood that other configurations are possible. For example, the front surface may be planar, angular, or prismatic and have a wide variety of finishes.

The present invention advantageously provides a block for use in building a retaining wall that produces a level course of blocks, despite the presence of a small amount of debris on the lower course of blocks.

The present invention is also advantageous in that it provides a relatively small block with material removed from strategic locations to provide a block which is lighter than it would have been had it been solid, yet the removal of material has not adversely affected the strength of the block, nor the appearance of the resulting wall.

The present invention advantageously provides a block that has areas for a person building a retaining wall to grasp the block when lifting the block off of a stack of such blocks and placing the block on a lower course of blocks in the wall being constructed.

These and other objectives and advantages of the invention will appear more fully from the following description, made in conjunction with the accompanying drawings wherein like reference characters refer to the same or similar parts throughout the several views.

DETAILED DESCRIPTION

Figure 1:
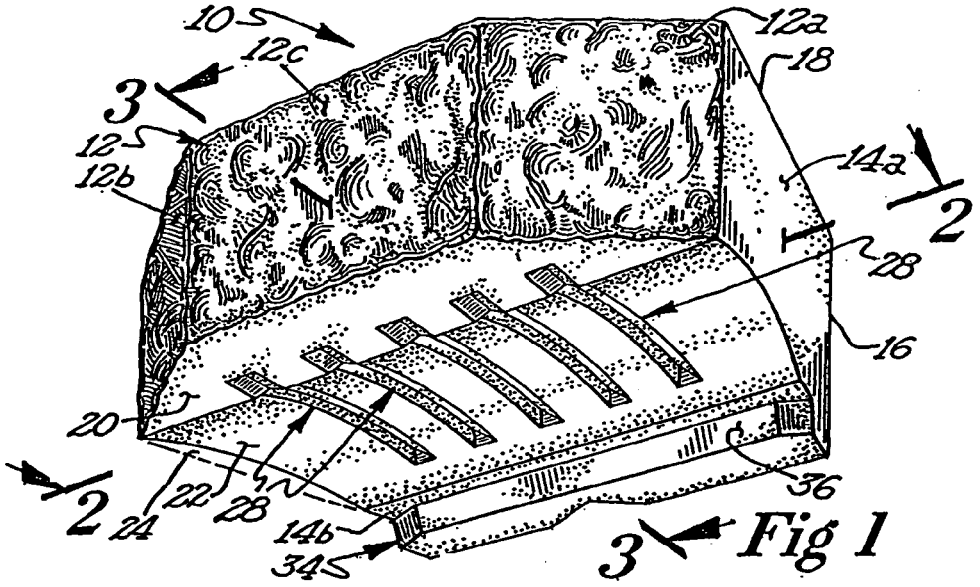
FIG. 1 is a perspective view of a block of the present invention, looking up at the bottom to reveal the details of the bottom surface.

Referring now to FIG. 1, there is shown a retaining wall block 10 having a front surface 12, side surfaces 14*a* and 14*b* extending rearwardly from front surface 12 and integral with rear surface 16. Top surface 18 is generally planar and continuous across its extents. Top surface 18 extends from side surface 14*a* to side surface 14*b*, and from front surface 12 to rear surface 16. Preferably, top surface 18 is generally perpendicular to side surfaces 14*a* and 14*b*, and also to front surface 12 and rear surface 16.

In the embodiment shown in FIGS. 1–9, front surface 12 comprises three parts, 12*a*, 12*b*, and 12*c*. Part 12*c* is generally parallel to rear surface 16 and lies between parts 12*a* and 12*b*. Parts 12*a* and 12*b* are angled such that they extend from part 12*c* and diverge rearwardly to meet side surfaces 14*a* and 14*b*, respectively. Parts 12*a*, 12*b*, and 12*c* are shown as split faces as opposed to formed or finished faces. Creating a face with a rock splitter results in an irregular, more natural appearing surface. Also shown in the Figures is a rear surface 16 that has a smaller width than front surface 12 such that side surface 14*a* and 14*b* must converge rearwardly in order to be integral with rear surface 16. This shape allows the construction of straight, concave, convex, or serpentine walls without interrupting the relatively uniform appearance created by the front surfaces 12 of a plurality of blocks 10 forming a wall.

Figure 3:
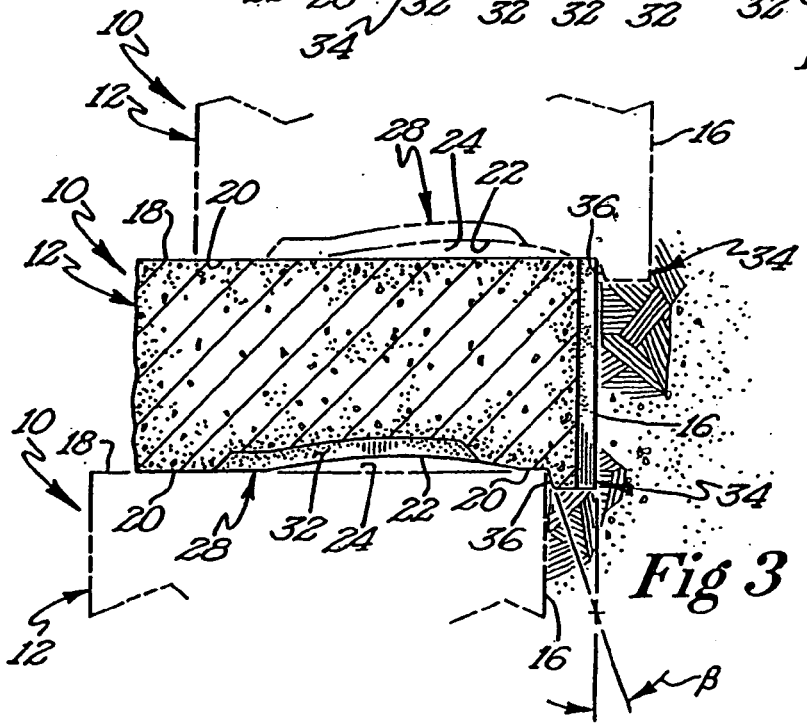
FIG. 3 is a cross sectional view of the block of the present invention taken along lines 3—3 of FIG. 1 and shown with other blocks in phantom, stacked, as in a retaining wall.
Figure 4:
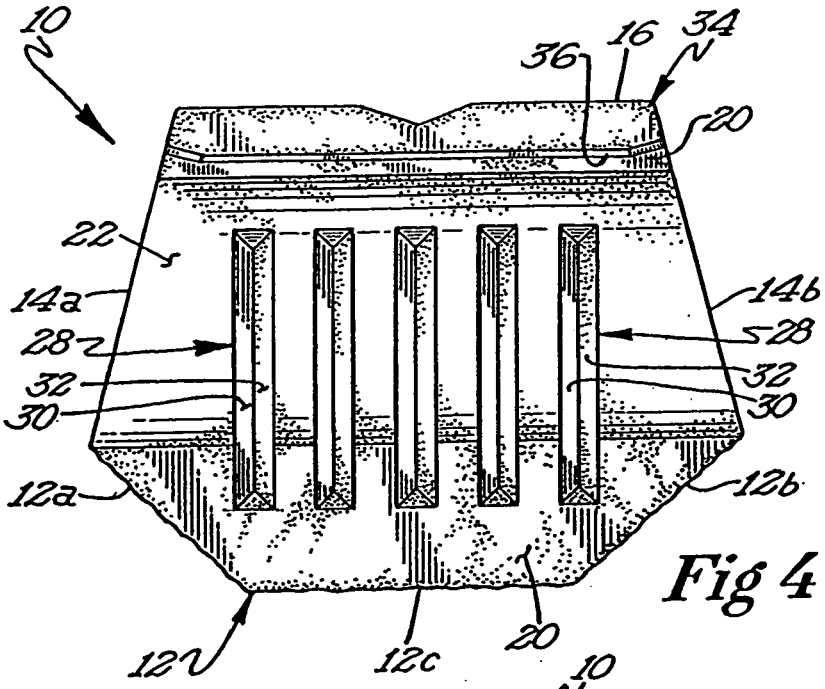
FIG. 4 is a bottom plan view of the block of FIG. 1.
Figure 5:
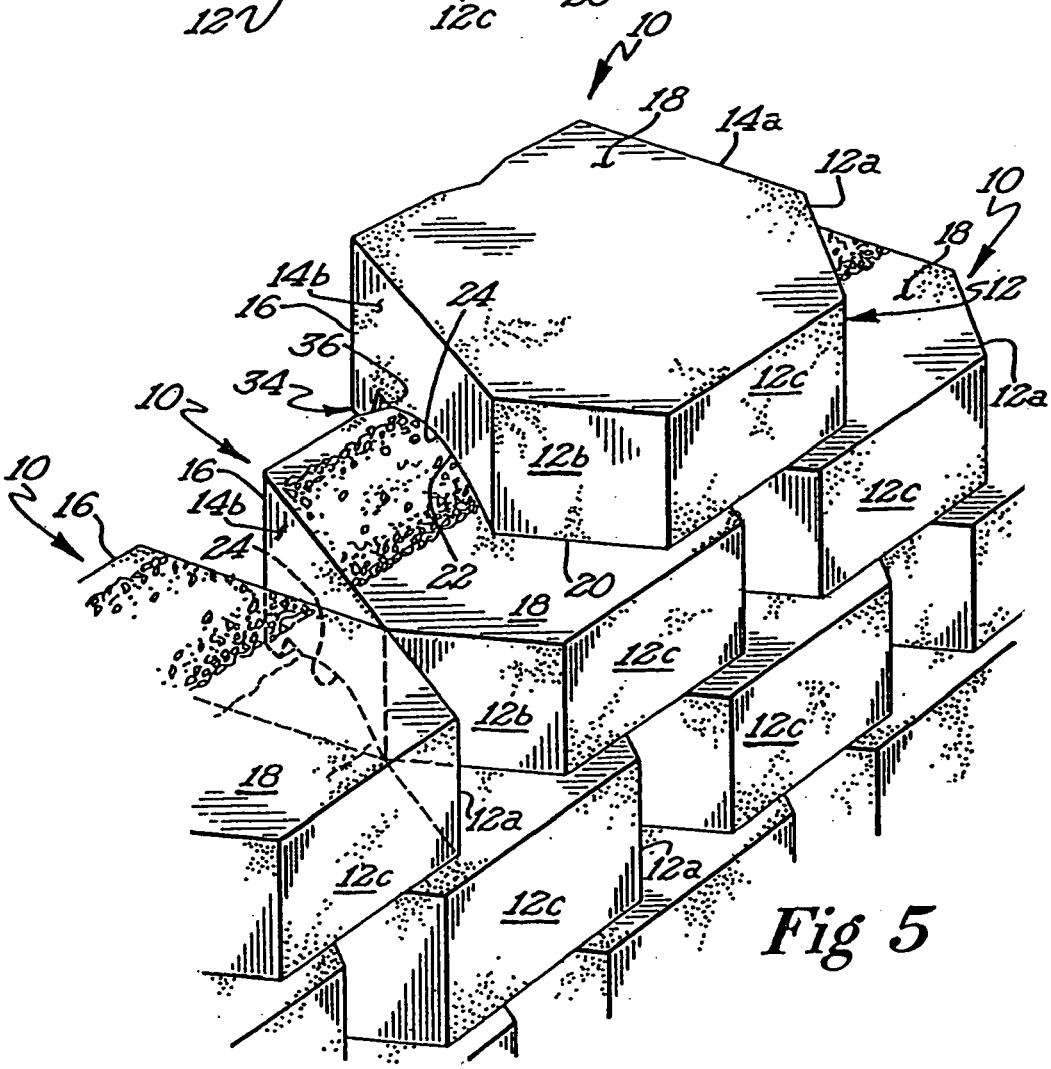
FIG. 5 is a perspective view of the block shown in FIG. 1 in a stacked relationship with other blocks, as in a wall, and showing debris resting on a lower course of blocks and accommodated for by the concave area of the bottom surface of the block of the present invention.

Bottom surface 20 extends from front surface 12 to rear surface 16 and from side surface 14*a* to side surface 14*b*. Bottom surface 20 includes a non-planar portion 22. Non-planar portion 22 is depicted in FIGS. 1, 3, and 4 as a relatively cylindrical indentation in bottom surface 20, extending from side surface 14*a* to side surface 14*b*. The non-planar portion 22 does not intersect the front surface 12, and preferably does not extend substantially forward of the intersection where side surfaces 14*a* and 14*b* meet parts 12*a* and 12*b* of front surface 12. This ensures that non-planar portion 22 is substantially hidden from view in a completed wall, regardless of whether the wall is straight, concave, convex, or serpentine.

Allowing non-planar portion 22 to extend from side surface 14*a* to side surface 14*b* creates a gap 24 between the bottom surface 20 and the upper surface of a lower course of blocks when block 10 is placed thereon. This gap 24 may be used for ease in picking the block up and setting the block down. Also, as shown in FIGS. 1, 3 and 4, non-planar portion 22 extends rearwardly but ends forward of downward projection 34, which is described in more detail below. Ending the non-planar portion 22 forward of downward projection 34 provides another flat surface for block-to-block contact to assist in the leveling and stabilization of block 10 on a lower course of blocks.

Alternatively, it is envisioned that non-planar portion 22 be an indentation of any shape, such as the generally ovate or spherical shape of the embodiment shown in FIGS. 6–9. Preferably, non-planar portion 22 is large enough to occupy at least 30 percent, more preferably on the order of 50 to 75 percent, of the surface area of bottom surface 20.

Figure 2:
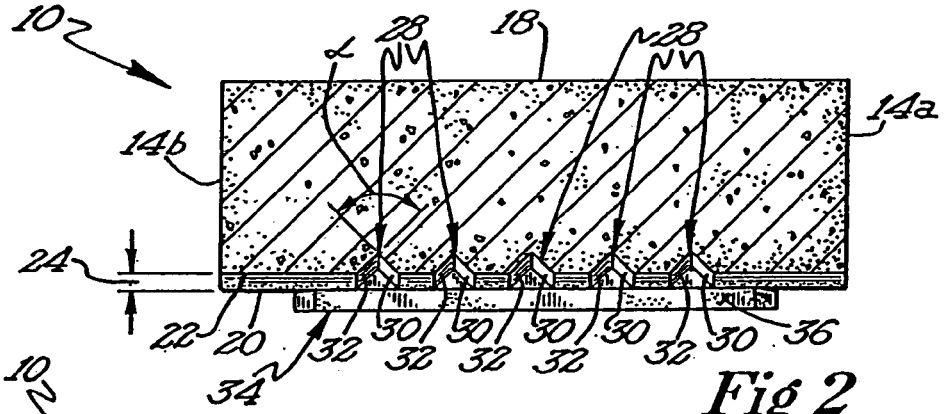
FIG. 2 is a cross sectional view of the block of the present invention taken along lines 2—2 of FIG. 1.

In one embodiment, bottom surface 20 also includes at least one, preferably a plurality of, grooves 28. As shown in FIG. 2, grooves 28 are preferably "V"-shaped and extend from the bottom surface into the block toward top surface 18. In the embodiment depicted in FIGS. 1 and 2, grooves 28 are spaced generally equidistant from each other and oriented such that they extend from front to back generally across the non-planar portion 22. It is envisioned that grooves 28 could be located generally anywhere across bottom surface 20. It is preferred, however, that grooves 28 do not intersect front surface 12 so that grooves 28 remain hidden from view when block 10 is part of a completed wall.

Figure 7:
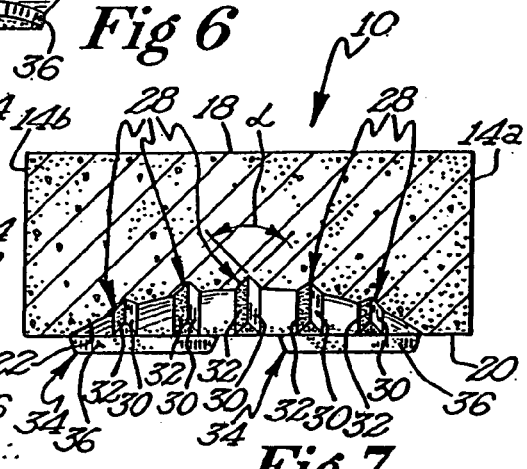
FIG. 7 is a sectional elevational view taken along lines 7—7 of FIG. 6.

Grooves 28 having the preferred "V" shape generally comprise at least a first surface 30 and a second surface 32. First surface 30 extends from bottom surface 20 and is integral with second surface 32. Second surface 32 extends from first surface 30 to bottom surface 20 thereby forming an angle $\alpha$ between first surface 30 and second surface 32 as seen in FIGS. 2 and 7. Angle $\alpha$ is preferably less than 180 degrees. Alternatively, first surface 30 and second surface 32 could be joined by a third surface (not shown in the Figures), which extends along the length of the groove and is juxtaposed between the first and second surfaces. This third surface could be curved, thereby forming a "U" shaped groove, or the third surface could be flat, thereby forming a rectangular groove. However, a "V" shaped groove generally eases manufacturing.

Figure 6:
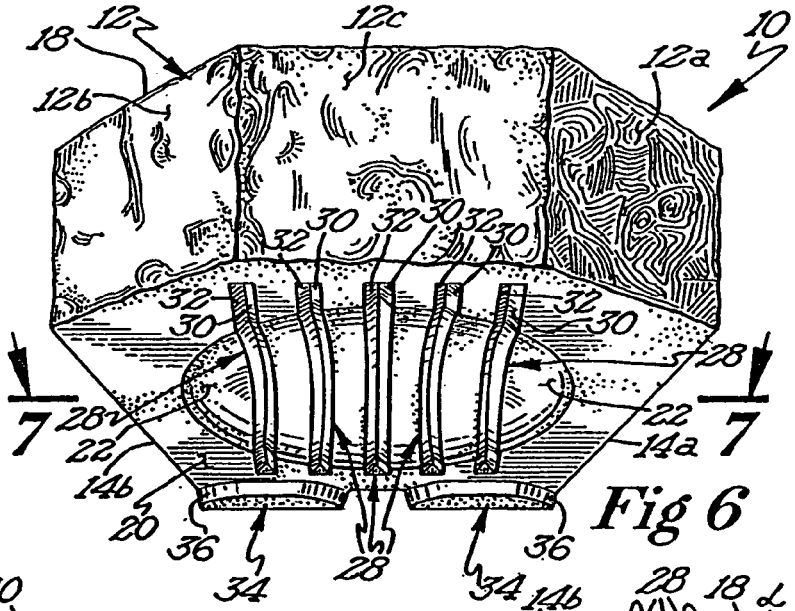
FIG. 6 is a perspective view of an alternative embodiment of the present invention, looking up at the bottom to show the detail of the bottom surface.
Figure 8:
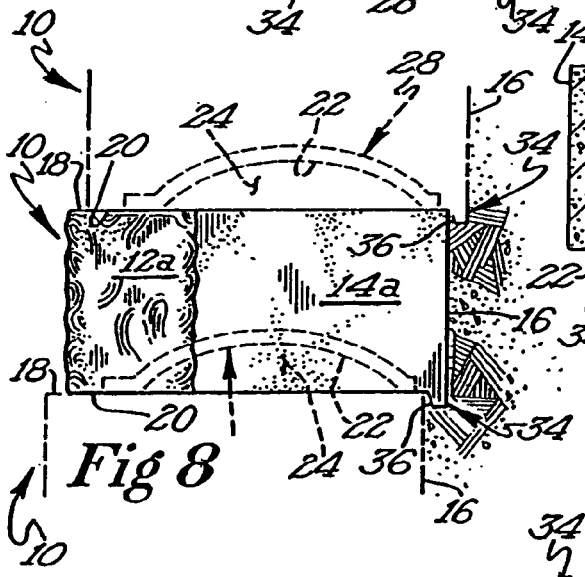
FIG. 8 is an end elevational view of a block of the embodiment shown in FIG. 6, in stacked relation, as in a wall, with other blocks shown in phantom.
Figure 9:
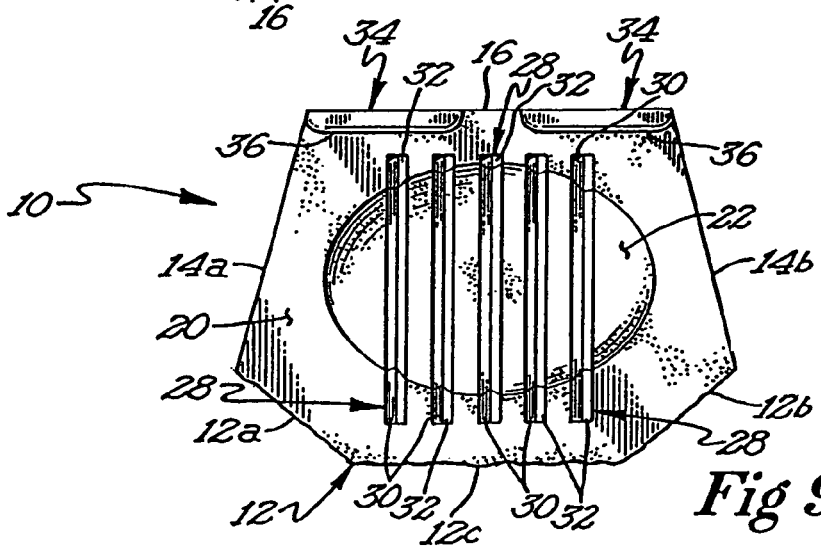
FIG. 9 is a bottom plan view of a block of the embodiment shown in FIG. 6.

As shown in all Figures, bottom surface 20 also includes at least one downward projection 34. Downward projection 34 may extend across bottom surface 20, adjacent rear surface 16 as shown in FIGS. 1, 2, and 4. Alternatively, projection 34 may be broken into more than one projection 34 as shown in FIGS. 6, 7 and 9. Projection 34 has an abutting surface 36 which is used to abut against the rear surface 16 of a lower course of blocks, thereby forming a setback between successive courses of blocks. This setback adds strength and stability to the resulting wall.

Abutting surface 36 may be substantially parallel to rear surface 16. Alternatively, for ease of manufacture, abutting surface 36 may angle rearwardly forming a relatively small angle $\beta$ with rear surface 16 as shown in FIG. 3. Angle $\beta$ is preferably less than 45 degrees, more preferably less than 30 degrees. A smaller angle $\beta$ provides more resistance to horizontal block slippage due to external forces against the back of the resulting wall.

Referring now to FIGS. 10–16, there is shown a preferred embodiment of a retaining wall block 50 having a front surface 52, side surfaces 54*a* and 54*b* extending rearwardly from front surface 52 toward rear surface 56. Top surface 58 is generally planar and continuous across its extents. Top surface 58 extends from side surface 54*a* to side surface 54*b*, and from front surface 52 to rear surface 56. Preferably, top surface 58 is generally perpendicular to side surfaces 54*a* and 54*b*, and also to front surface 52 and rear surface 56.

In the embodiment shown in FIGS. 10–16, front surface 52 comprises three parts, 52*a*, 52*b*, and 52*c*. In general, these parts will referred to as the front surface parts or as the face of the block 50. Part 52*c* is generally parallel to rear surface 56 and lies between parts 52*a* and 52*b*. Parts 52*a* and 52*b* are angled such that they extend from part 52*c* and diverge rearwardly to meet side surfaces 54*a* and 54*b*, respectively. Parts 52*a*, 52*b*, and 52*c* are in FIGS. 10–16 shown as formed or smooth faces as opposed to split faces. Block 50 may preferably be formed by splitting as described above in conjunction with FIGS. 1–9. Creating a face with a rock splitter results in an irregular, more natural appearing surface. As can be seen in the Figures, rear surface 56 has a smaller width than front surface 52. Side surfaces 54*a* and 54*b* converge rearwardly toward the rear surface 56 at obtuse angle to the rear surface 56. This shape allows the construction of straight, concave, convex, or serpentine walls without interrupting the relatively uniform appearance created by the front surfaces 52 of a plurality of blocks 10 forming a wall.

Block 50 has a heel portion 70 that comprises the rear surface 56, a projection 72, and a gutter 74. As can be seen most clearly in FIGS. 10 and 13, sides 54*a* and 54*b* incorporate shoulders 76*a* and 76*b*, respectively. Shoulders 76 may also be seen as a forward boundary of the heel portion 70 of the block 50. Note that shoulders 76 form an obtuse angle with respect to sides 54. Heel portion side walls 78*a* and 78*b* extend rearwardly from respective shoulders 76*a* and 76*b* and intersect with rear surface 56 of block 50. Heel portion side walls 78*a* and 78*b* are preferably formed perpendicular to shoulders 76*a* and 76*b* and to rear surface 56 of block 50. The resulting sides 54 comprise multiple facets and provide a number of benefits. Formation of side walls 78*a* and 78*b* as illustrated in the FIGS results in a lighter block 50 as the block 50 will have a smaller volume. As a corollary benefit, less concrete material is used in the formation of block 50 where side walls 78*a* and 78*b* are formed as indicated.

Bottom surface 60 extends from front surface 52 to gutter 74 and from side surface 54*a* to side surface 54*b*. Bottom surface 60 includes a non-planar portion 62. Non-planar portion 62 is depicted in FIGS. 11, 12, 15, and 16 as a relatively cylindrical indentation in bottom surface 60, extending from side surface 54*a* to side surface 54*b*. Preferably, non-planar portion 62 does not extend substantially forward of where side surfaces 54*a* and 54*b* intersect parts 52*a* and 52*b* of front surface 52. In this way non-planar portion 62 will be substantially hidden from view in a completed wall, regardless of whether the wall is straight, concave, convex, or serpentine.

Allowing non-planar portion 62 to extend from side surface 54*a* to side surface 54*b* creates a gap 64 between the bottom surface 60 and the upper surface of a lower course of blocks when block 50 is placed thereon. This gap 64 may be used for ease in picking the block 50 up and setting the block down. As can be seen in FIGS. 11, 12, 15, and 16, gap 64 extends all the way to the edge 75 of gutter 74. Because gap 64 extends all the way to edge 75 of gutter 74, a block 50 in an upper course of blocks will rest upon a block 50 in a lower course of blocks upon that portion of bottom surface 60 that extends between the front face parts 52*a*, 52*b*, and 52*c* and the forward edge 63 of the non-planar portion 62 and the edge 75 of gutter 74. As can be appreciated, the rear of the block 50 is supported only on edge 75 and not on a planar surface, i.e. edge 75, while having any number of curvilinear and/or rectilinear shapes, has a small surface area with respect to the remainder of bottom surface 60. This affords the benefits of increased friction between two courses of blocks 50 and prevents the entrapment of sand, gravel, or bits of concrete between the upper surface 58 of a lower course of blocks and the bottom surface 60 of an upper course of blocks.

Gutter 74 extends upwardly from edge 75 into the body of block 50 toward the top surface 58. Gutter 76 extends laterally between heel portion side walls 78*a* and 78*b* and has a generally "U" shaped cross-sectional area. Note that the exact cross-sectional shape of the gutter 76 may vary. However it is important to form the gutter 74 without sharp-edged surfaces. Therefore, the cross-sectional shape of the gutter 74 will be gently curved within the constraints of its position and size. Such a shape avoids the formation of unwanted stress concentration points that might facilitate the fracture of the block.

The rear face of the gutter 74 extends downwardly, away from the top surface of block 50 and beyond edge 75 to form an abutting surface 80 of projection 72. Projection 72 and its abutting surface 80 function in the same manner as projection 34 and its abutting surface 36, described above. That is, projection 72 acts to rearwardly offset each course of blocks 50 from the lower course upon which the upper course of blocks 50 rest. Projection 72 is preferably offset forwardly from the rear surface 56. As can be seen in the Figures, rear face 82 of projection 72 is moved forward of the rear surface 56 of the block 50. Additionally, it is preferred to cant the rear face 82 of projection 72 forwardly so that the projection has a generally trapezoidal cross-sectional shape with radiused edges. While this trapezoidal shape is not the only shape that may be used, it does afford additional durability to the projection 72 in that the lack of sharp edges prevents chipping and fracture of the projection 72. The trapezoidal shape of the abutting surface 80 of the projection 72 aids in the rapid construction of walls by preventing the entrapment of sand, gravel, or pieces of concrete between the abutting surface 80 of the projection 72 of a block 50 in an upper course and the rear surface 56 a block 50 in a lower course.

The formation of a heel structure 70 such as that illustrated in FIGS. 10–16 has the additional benefit of strengthening the projection 72 by forcing more of the concrete from which the blocks 50 are formed into the area of the mold that forms the projection 72. Projection 72 of block 50 therefore has fewer voids, is more dense and is consequently stronger.

Figure 10:
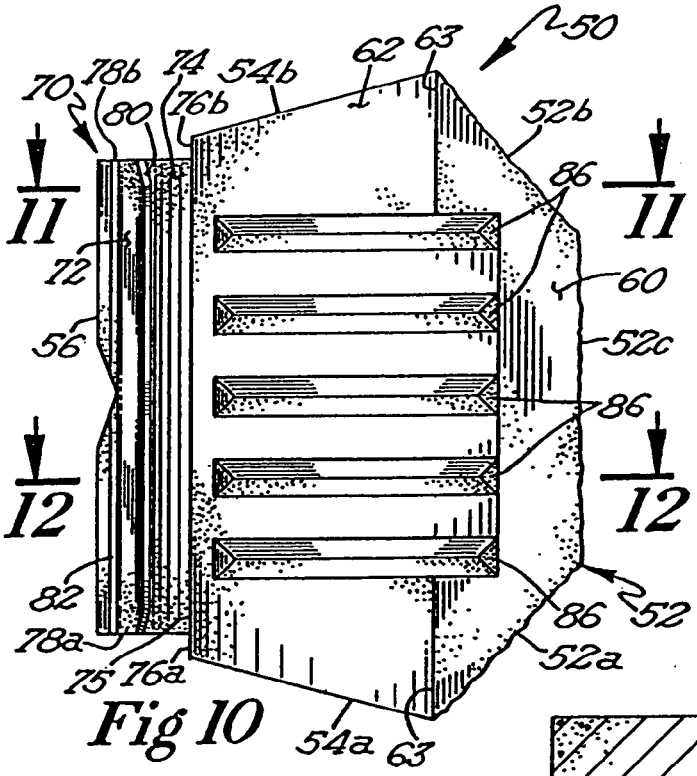
FIG. 10 is a bottom plan view of a block of the present invention.

In the preferred embodiment, bottom surface 60 also includes at least one, and preferably a plurality of, grooves 86 that are similar in shape and disposition to the grooves 28 described above in conjunction with FIGS. 1 and 2. Grooves 86 preferably have the "V"-shape as described above. While the grooves 86 may be located generally anywhere across the bottom surface 60, it is preferred to locate the grooves substantially within the curved portion 62 of the bottom surface 60. As seen in FIG. 10, grooves 68 may extend from front to back from a position on surface 60 somewhat forward of the point where front surfaces 52*a* and 52*b* interest side surfaces 54*a* and 54*b*, respectively, to a position just forward of edge 75 of gutter 74. Care must be taken to space the grooves 86 away from edge 75 sufficiently to avoid weakening edge 75. Grooves 86 not only result in a lighter block 50, but also realize a cost savings in the use of less concrete to form the blocks 50. Additionally, grooves 86 may aid installers in the field by providing a fracture line along with the block 50 may be broken to fill a gap in wall made from blocks 50.

Figure 13:
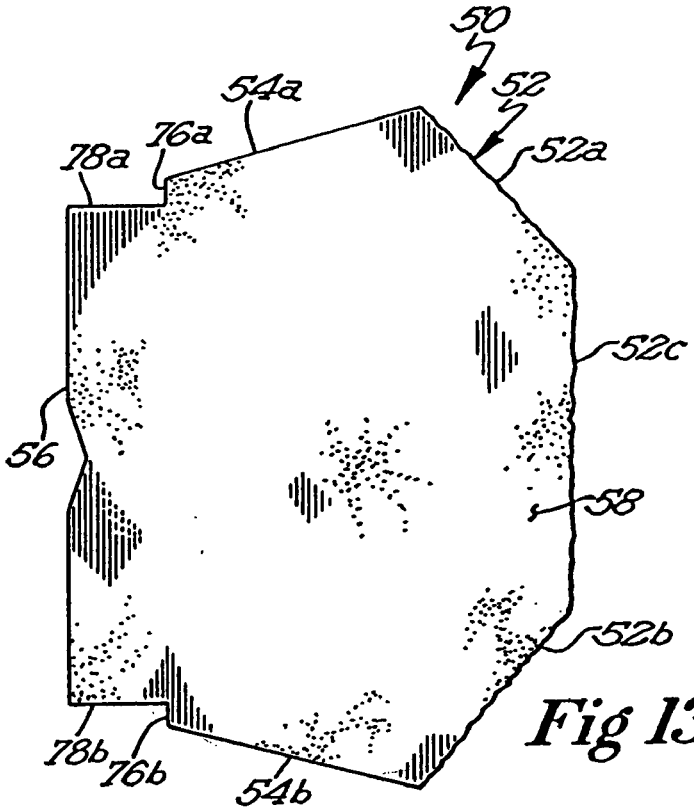
FIG. 13 is a top plan view of the block of FIG. 10.
Figure 15:
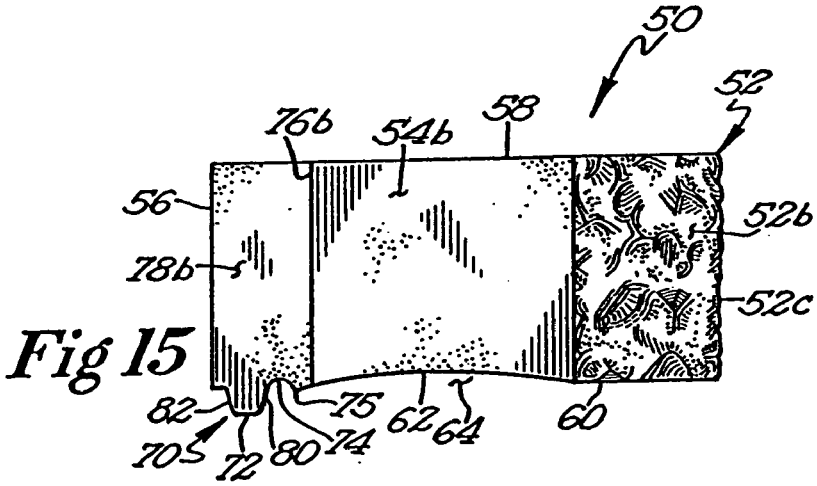
FIG. 15 is a side elevational view of a first side of the block of FIG. 10.
Figure 16:
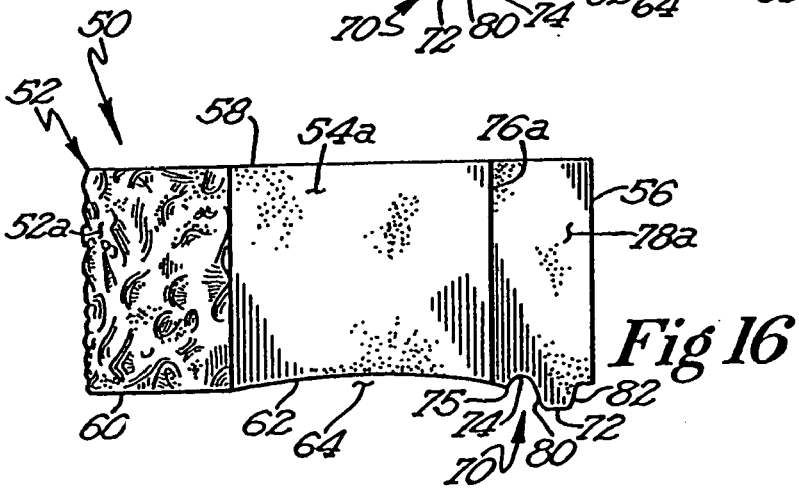
FIG. 16 is a side elevation view of a second side of the block of FIG. 10.
Figures 17, 18:
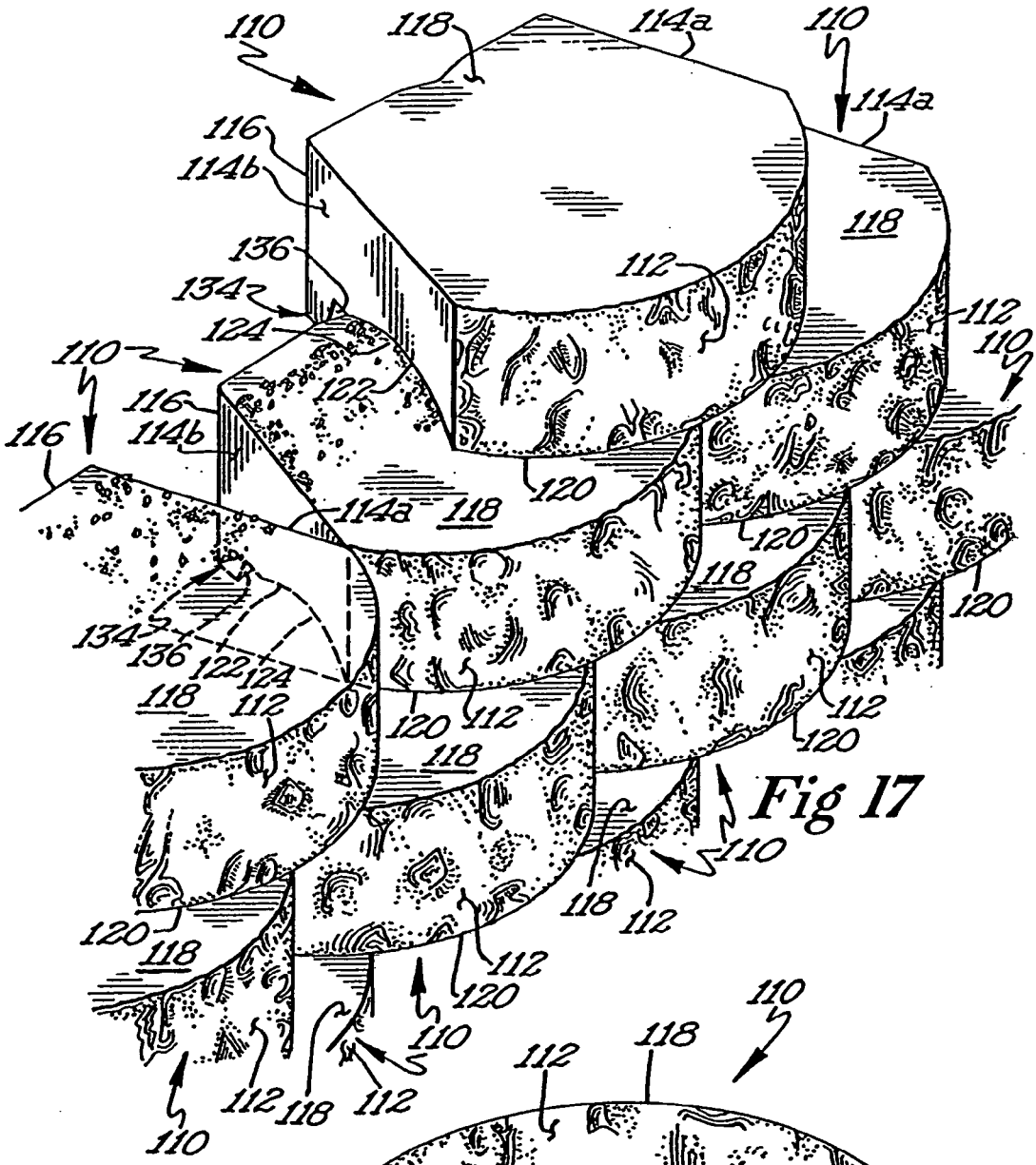
FIG. 17 is a perspective view of an alternative embodiment of the block shown in FIG. 1 in a stacked relationship with other blocks, as in a wall, and showing debris resting on a lower course of blocks and accommodated for by the non-planar area of the bottom surface of the block of the present invention and also showing a curved front surface.
FIG. 18 is a perspective view of an alternative embodiment of the present invention, looking up at the bottom to show the detail of the bottom surface.

Referring now to FIG. 17, block 110 includes a front surface 112 that comprises an outwardly curved, or curvilinear surface that is free from vertices that extend substantially from the top surface to the bottom surface, as opposed to a block having a front surface with vertices formed by facets, as depicted in FIG. 13, for example. Although the front surface 112 is depicted as having a roughened texture that approximates a split-face look, it will be appreciated that other textures are possible. Also shown in the Figure is a rear surface 116 which has a smaller width than front surface 112 such that side surface 114*a* and 114*b* converge rearwardly in order to be integral with rear surface 116. This shape allows the construction of straight, concave, convex, or serpentine walls without interrupting the relatively uniform appearance created by the front surfaces 112 of a plurality of blocks 110 forming a wall. As will be appreciated, the curvature of the front surface 112 of the block 110 may be configured so that the front surfaces of a plurality of blocks may also form closed, substantially cylindrical structures.

Although not depicted, the bottom surface of the block of this embodiment is identical to the bottom surface depicted in FIGS. 1 and 4. Thus, the bottom surface extends from front surface to rear surface 116 and from side surface 114*a* to side surface 114*b*. Bottom surface includes a non-planar portion with a plurality of upwardly extending grooves (not shown). Non-planar portion is similar to the non-planar portion 22 depicted in FIGS. 1, 3 and 4, in that it is relatively cylindrical and extends from side surface 14*a* to side surface 14*b*. As with the non-planar portion 22 of FIGS. 1, 3, and 4, the non-planar portion of this embodiment does not extend substantially forward of the points where side surfaces 114*a* and 114*b* intersect with the front surface 112. This enables the non-planar portion to be substantially hidden from view in a completed wall, regardless of whether the wall is straight, concave, convex, or serpentine. Similarly, extending the non-planar portion from side surface 114*a* to side surface 114*b* creates a gap 124 between the bottom surface and the upper surface of a lower course of blocks that may also be used to facilitate manipulation of the block. Also, as shown in the Figure, non-planar portion 122 extends rearwardly towards downward projection 134, but stops short a predetermined distance therebefore.

Figure 19:
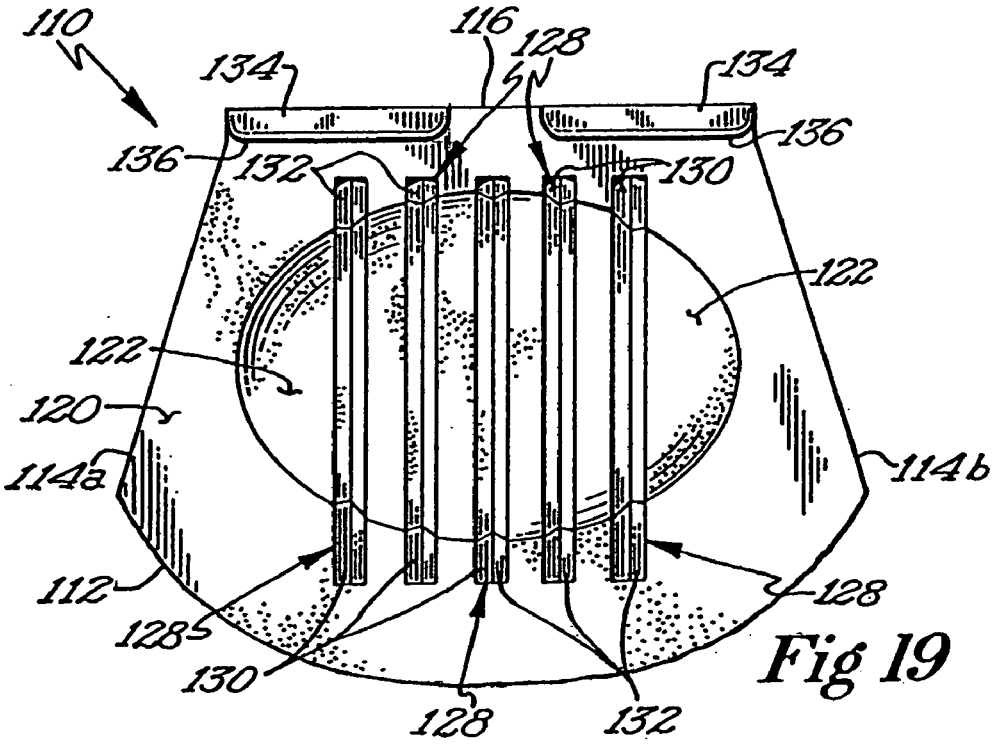
FIG. 19 is a bottom plan view of a block of the embodiment shown in FIG. 18.

Referring now to FIGS. 18 and 19, another embodiment shows a block 110 that includes a front surface 112 that comprises an outwardly curved, or curvilinear surface, which is free from vertices that extend substantially from the top surface to the bottom surface. The front surface 112 of this embodiment is also depicted as having a roughened texture that approximates a split-face look, but it is understood that other textures are possible. As with the embodiment as depicted in FIGS. 6–9, the block of this embodiment includes a non-planar portion 122 that is substantially concave or ovate in shape, and a plurality of upwardly extending "V" shaped grooves 128 having convergent surfaces 130, 132.

Figure 20:
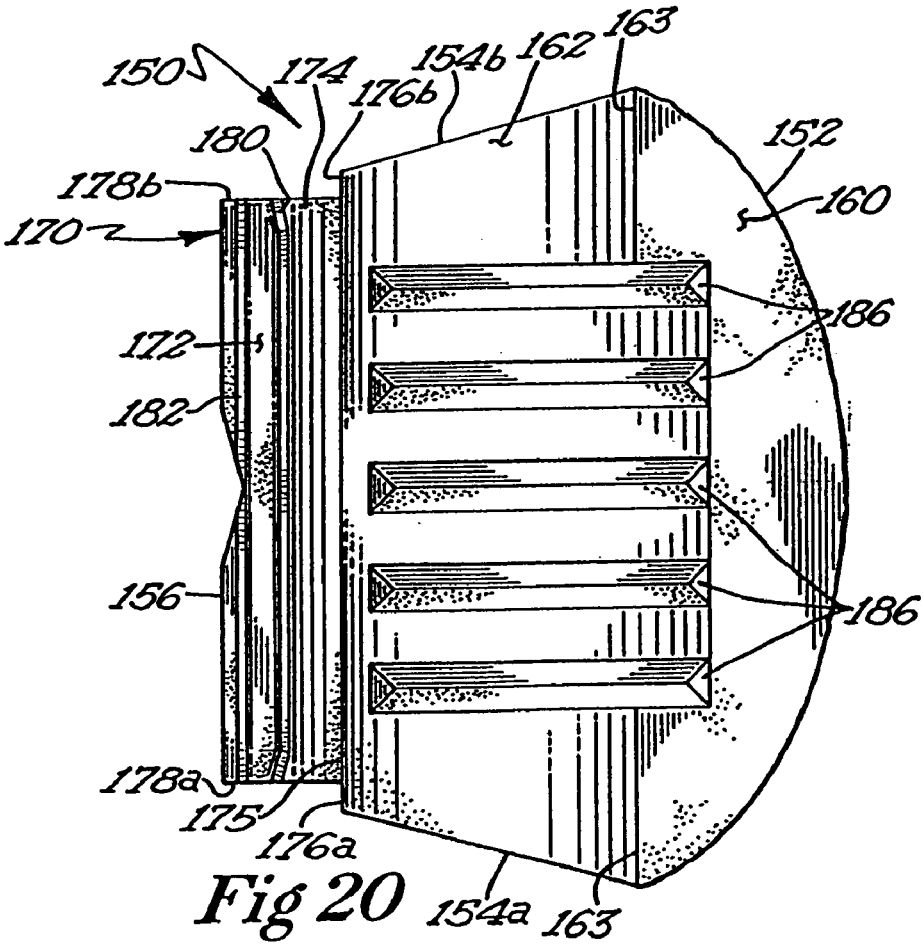
FIG. 20 is a bottom plan view of an alternative embodiment of the block of the present invention in which the front surface is curved.

Referring now to FIG. 20, another embodiment shows also shows a block 150 that includes a front surface 152 that comprises an outwardly curved or curvilinear surface, which is free from vertices that extend substantially from the top surface to the bottom surface, as opposed to a block having a front surface with vertices formed by facets, as depicted in FIG. 13, for example. Retaining wall block 150 also includes side surfaces 154*a* and 154*b* that extend rearwardly from front surface 152 toward rear surface 156. Bottom surface 160 extends from front surface 152 to a gutter 174 and from side surface 154*a* to side surface 154*b*. Bottom surface 160 includes a non-planar portion 162 that is a relatively cylindrical indentation in bottom surface 160, extending from side surface 154*a* to side surface 154*b* (See also, FIG. 23). The non-planar portion 162 is arranged so that it stops short of the front surface 152, and preferably does not extend substantially forward of the points of intersection where side surfaces 154*a* and 154*b* meet the front surface 152. This ensures that non-planar portion 162 is substantially hidden from view in a completed wall, regardless of whether the wall is straight, concave, convex, or serpentine.

A gap 164, formed by the non-planar portion 162, extends all the way from a forward edge 163 to the edge 175 of gutter 174. Thus, a block 150 in an upper course of blocks will rest upon a block 150 in a lower course of blocks upon that portion of bottom surface 160 that extends between the front surface 152 and the forward edge 163 of the non-planar portion 162, and the edge 175 of gutter 174.

Figure 11:
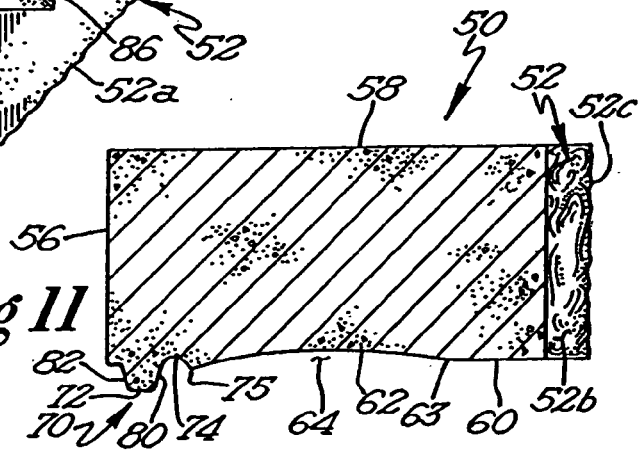
FIG. 11 is a cross-sectional view of the block of FIG. 10 taken along cutting lines 11—11 in FIG. 10.
Figure 12:
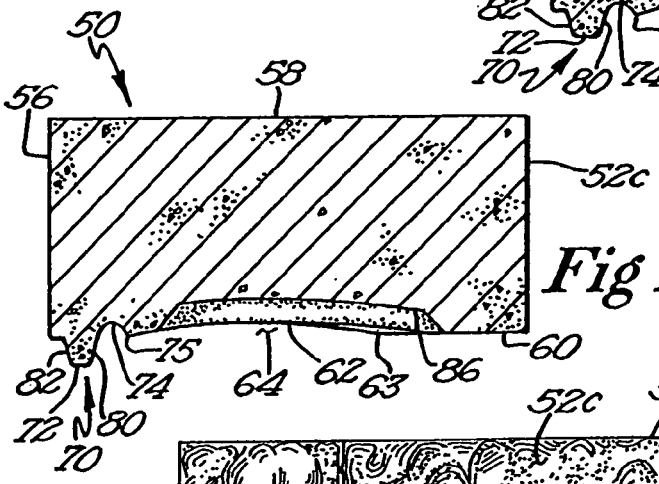
FIG. 12 is a cross-sectional view of the block of FIG. 10 taken along cutting lines 12—12 in FIG. 10.
Figure 14:
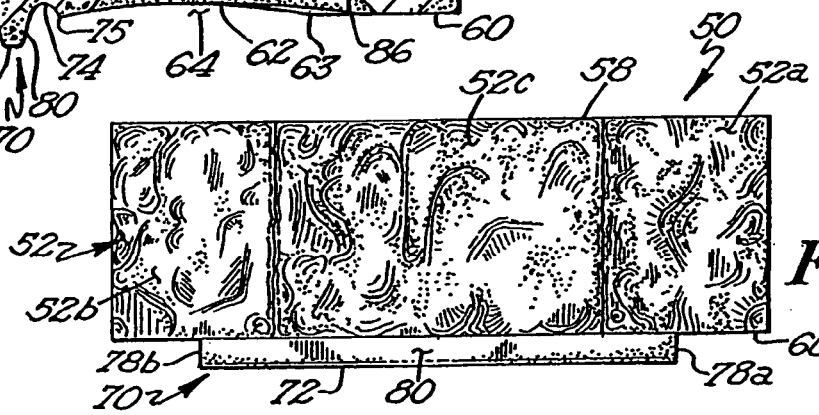
FIG. 14 is a front elevational view of the block of FIG. 10.

In this embodiment, bottom surface 160 also includes at least one, and preferably a plurality of, grooves 186 that are similar in shape and disposition to the grooves 28 described above in conjunction with FIGS. 1 and 2, and as depicted in FIGS. 10, 11, and 12. Grooves 186 preferably have the "V"-shape as described above. While the grooves 186 may be located generally anywhere across the bottom surface 160, it is preferred to locate the grooves substantially within the curved portion 162 of the bottom surface 160. As seen in FIG. 20, grooves 168 may extend substantially from front to back from a position on surface 160 somewhat forward of the point where front surface 152 interests side surfaces 154*a* and 154*b*, respectively, to a position just forward of edge 175 of gutter 174. Grooves 186 not only result in a lighter block 150, but also realize a cost savings in the use of less concrete to form the blocks 150. Additionally, grooves 186 may aid installers in the field by providing a fracture line along with the block 150 may be broken to fill a gap in wall made from blocks 150.

Block 150 also has a heel portion 170 that comprises the rear surface 182, a projection 172 and a gutter 174. As can be seen more clearly in FIG. 21, sides 154*a* and 154*b* incorporate shoulders 176*a* and 176*b*, respectively. Shoulders 176 may also be seen as a forward boundary of the heel portion 170 of the block 150. Note that shoulders 176 form an obtuse angle with respect to sides 154. Heel portion side walls 178*a* and 178*b* extend rearwardly from respective shoulders 176*a* and 176*b* and intersect with rear surface 156 of block 150. Heel portion side walls 178*a* and 178*b* are preferably formed perpendicular to shoulders 176*a* and 176*b* and to rear surface 156 of block 150. The resulting sides 154 comprise multiple facets and provide a number of benefits. Formation of side walls 178*a* and 178*b* as illustrated in the Figures results in a lighter block 150 as the block 150 will have a smaller volume.

Figure 21:
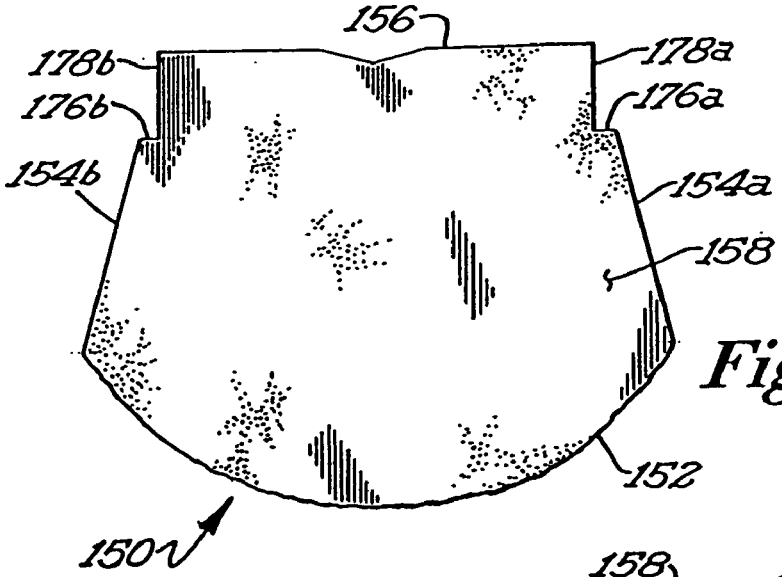
FIG. 21 is a top plan view of the block of FIG. 20.

Referring now to FIG. 21, top surface 158 is generally planar and continuous across its extents. Top surface 158 extends from side surface 154*a* to side surface 154*b*, and from front surface 152 to rear surface 156. Preferably, top surface 158 is generally perpendicular to side surfaces 154*a* and 154*b*, and also to front surface 152 and rear surface 156. As can be seen in the Figures, rear surface 156 has a smaller width than front surface 152. Side surfaces 154*a* and 154*b* converge rearwardly toward the rear surface 156 at obtuse angle to the rear surface 156

Figure 22:
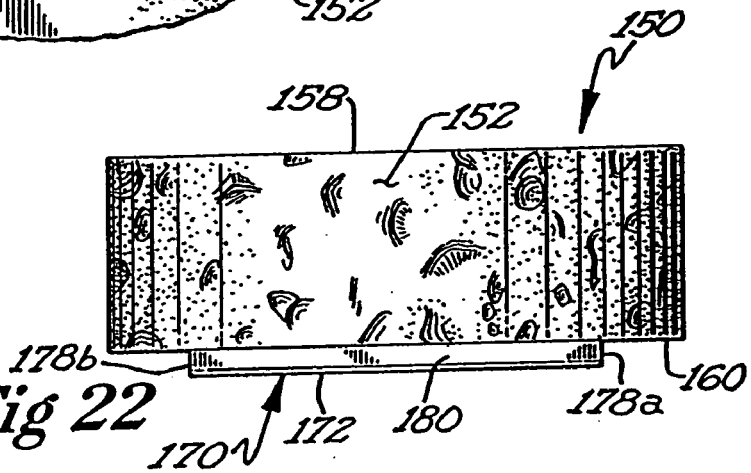
FIG. 22 is a front elevation view of the block of FIG. 20.

Referring now to FIG. 22, the front surface 152 comprises a curvilinear surface that may be curved outwardly. This curvature enables blocks 152 to form wall structures that are substantially cylindrical. Although a relatively shallow arc that extends between the sides 154*a*, 154*b* is depicted, it will be appreciated that front surface 152 may be formed in different arcs, for example, a hemispherical arc. Moreover, the arced front surface 152 may be oriented so that it extends between the top and bottom surfaces 158, 160, or comprises a series of curvilinear surfaces in a scallop-like configuration.

Figure 23:
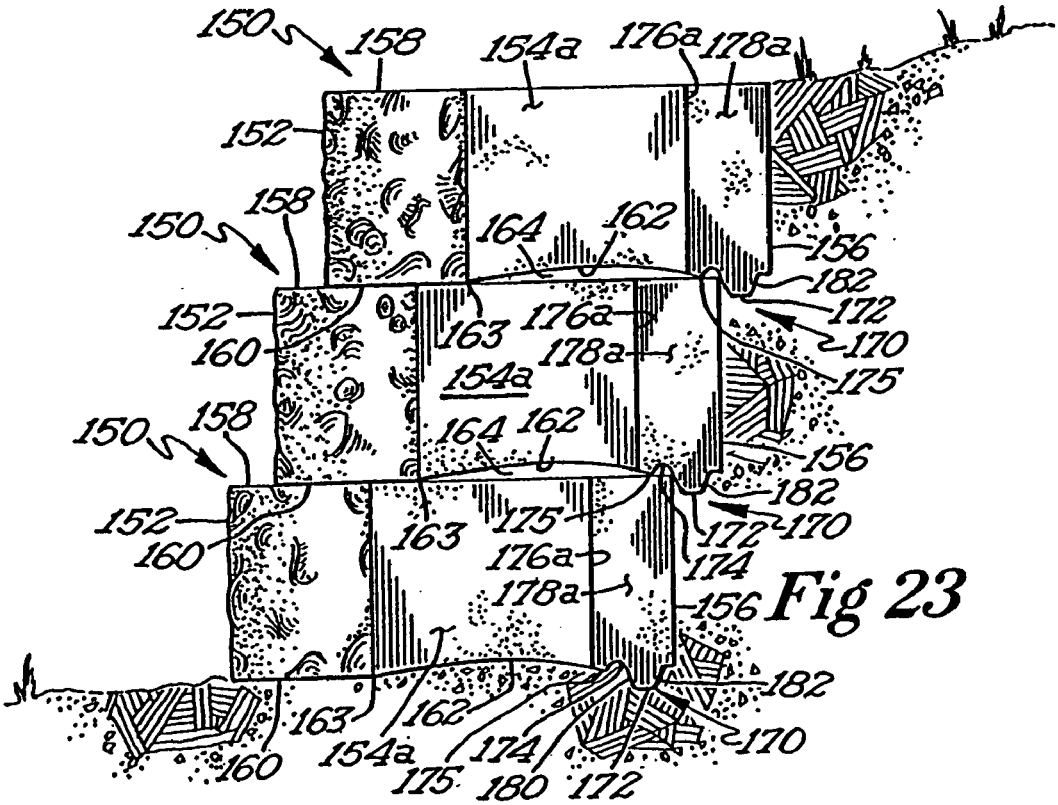
FIG. 23 is a side elevation view of a series of blocks of FIG. 20 as they would appear in a stacked relation.

Referring now to FIG. 23, gap 164 between adjacent courses of blocks 150 can be more easily seen. As with the previous embodiments, gap 164 may be used to facilitate manipulation of blocks 150. As can be appreciated, the rear of the block 150 is supported only on edge 175 and not on a planar surface. This minimizes the surface area supporting the rear of the block 150 and reduces the effects of extraneous material such as rocks, sand, or bits of concrete that may be present on the upper surface 158 of a lower course of blocks.

Gutter 174 has a generally "U" shaped cross-sectional area that extends upwardly from edge 175 into the body of block 150 and laterally between heel portion side walls 178*a* and 178*b*. As will be appreciated, the exact cross-sectional shape of the gutter 176 may vary. The rear face of the gutter 174 extends downwardly, away from the top surface of block 150 and beyond edge 175 to form an abutting surface 180 of projection 172. Projection 172 and its abutting surface 180 functions in the same manner as projection 34 and its abutting surface 36, described above. Projection 172 is preferably offset forwardly from the rear surface 156. As can be seen in the Figures, rear face 182 of projection 172 is moved forward of the rear surface 156 of the block 150 so that the projection 172 is generally intermediate or interposed between the rear surface 156 and the rear edge 175 of the non-planar portion 162. The positioning of the projection 172 away from the rear surface has an advantage in that it is less likely to be chipped and fractured while the block is being manipulated and positioned. In other words, it is in a location that offers greater protection. Note that the abutting surface 180 and the rear face 182 of projection 172 are canted towards each other so that the projection 172 has a generally trapezoidal cross-sectional shape. The trapezoidal shape of the projection 172 aids in the rapid construction of walls by preventing the entrapment of sand, gravel, or pieces of concrete between the abutting surface 180 of a block 150 in an upper course and the rear surface 156 a block 150 in a lower course.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A block for constructing a retaining wall, the block comprising:

a substantially contiguous top surface;

a bottom surface spaced a predetermined distance from said top surface;

a front surface extending vertically between said top and bottom surfaces and horizontally in a predetermined lateral extent;

a rear surface spaced a predetermined distance from said front surface, the rear surface extending vertically between said top and bottom surfaces and horizontally in a predetermined lateral extent; and, side surfaces spaced apart from each other, with each side surface extending vertically between said top and bottom surfaces and horizontally between said front and rear surfaces, each side surface comprising at least three plurality facets including a first facet extending from the front surface, a second facet extending from the rear surface, and a third facet extending from the second facet, the second and third facets defining a notch in the side surface adjacent the rear surface, the notch extending from the top surface to the bottom surface wherein said bottom surface further comprises a projection extending downwardly therefrom, the projection having an abutting surface configured and arranged to contact the rear surface of a lower course of blocks when said block is placed thereon, the abutting surface operating to position said block in a predetermined relation relative to the lower course of blocks on which it is placed.

2. The block of claim 1, wherein the lateral extent of said front surface is greater than the lateral extent of said rear surface.

3. The block of claim 1, wherein said abutting surface extends substantially between said side surfaces.

4. The block of claim 1, wherein the second facets of the side surfaces are substantially parallel to each other and substantially perpendicular to the rear surface of said block.

5. The block of claim 1, wherein the third facet of at least one of the side surfaces is substantially parallel to the rear surface.

6. The block of claim 1, wherein the third facet of one of the side surfaces is substantially co-planar with the third facet of the other side surface.

7. The block of claim 1, wherein the third facet of at least one of the side surfaces forms a shoulder.

8. The block of claim 1, wherein the front surface is free from vertices that extend substantially from the top surface to the bottom surface.

9. The block of claim 1, wherein the front surface is substantially curvilinear.

* * * * *